United States Patent [19]

Steward et al.

[11] 4,139,429

[45] Feb. 13, 1979

[54] ELECTROLYTIC CELL

[75] Inventors: Frederick A. Steward, Zelienople; James H. Weet, Mars, both of Pa.

[73] Assignee: Dart Industries Inc., Los Angeles, Calif.

[21] Appl. No.: 916,327

[22] Filed: Jun. 15, 1978

[51] Int. Cl.[2] ..... C25C 1/00; C25D 21/10; C25D 17/02

[52] U.S. Cl. ..... 204/105 R; 204/237; 204/273

[58] Field of Search ..... 204/237, 273, 105 R, 204/277

[56] References Cited

U.S. PATENT DOCUMENTS

| | | | |
|---|---|---|---|
| 1,483,722 | 2/1924 | Eustis | 204/237 X |
| 3,415,732 | 12/1968 | Komjathy | 204/237 |
| 3,558,455 | 1/1971 | Sorensen et al. | 204/273 X |
| 4,022,678 | 5/1977 | Wojcik et al. | 204/273 |

*Primary Examiner*—John H. Mack
*Assistant Examiner*—D. R. Valentine
*Attorney, Agent, or Firm*—Margareta LeMaire; Bryant W. Brennan; Fred S. Valles

[57] ABSTRACT

An electrolytic plating cell is provided, wherein by means of flow directional baffle arrangements a rapid, uniform parallel movement of the electrolyte past all electrode surfaces can be maintained, while minimizing energy losses in moving the electrolyte.

7 Claims, 3 Drawing Figures

ELECTROLYTIC CELL

BACKGROUND OF THE INVENTION

It is well known that all electrolytic metal refining or recovery processes are limited, insofar as the applicable current density is concerned, by the rate with which metal ions are diffused from the electrolyte into the liquid film layer adhering to the cathode surface. The higher the metal deposition rate on the cathode, and thus the higher the depletion rate of metal ions from the cathode film, the more this limitation affects the current efficiency, and the smoothness, crystal structure and density of the deposit. Specifically, when the rate of metal ion removal from the cathode film for deposit onto cathode surface exceeds the diffusion rate of metal ions from the electrolyte into the cathode film for replenishment, a considerable portion of the current is made available for hydrogen deposition rather than metal deposition. Under these conditions crystal growth does not occur parallel with the cathode surface, the resulting metal deposits are of poor quality in that they usually are powdery, rough-textured, poorly adhering coatings of insufficient thickness. Also, more frequent shut-downs for cleaning of the cell are required to prevent short-circuiting caused by bridging of the electrodes by metallic deposits, which have either flaked off from the cathode into the electrolyte or have grown out of the cathode surface as so called "dentrites", i.e. irregular tree-like formations.

When using soluble metal anodes high current density electrodissolution creates a somewhat similar problem inasmuch as the metal is dissolved from the anode at a greater rate than the rate of diffusion of the metal into the main body of the electrolyte. As a result, the anode film layer becomes enriched in metal salts to such an extent that it becomes highly viscous and also depleted in solvent anions, the resistance is greatly increased, the current flow is impeded, and the desired smooth, uniform dissolution is affected.

It is apparent from the above that there is a maximum or "limiting" current density that can be used in any particular electrolytic system for deposits of metal of acceptable quality, especially if the aim is to build up a heavy deposit, such as is the case in most commercial electrowinning or refining processes. Since the current density that can be employed is directly related to the surface area of the electrodes and therefore the size and capital cost of the entire electrolytic cell, it follows that any improvement, which serves to increase the "limiting" current density without adding significant further costs would be highly desirable.

Generally, it has been recognized by those familiar with the art that the aforementioned diffusion rate decreases with increasing electrode film thickness and therefore, a reduction of this film thickness is one of the best approaches for solving the problem. Agitation, i.e. a rapid movement of the electrodes or the electrolyte relative to each other is most helpful in this respect. For the agitation to be meaningful it should act parallel to the electrode surface.

Various methods of agitation have been suggested and used with limited success including mechanical movement of the electrodes and direct movement of the electrolyte. Of the former, the most common method is mechanical reciprocation of the electrodes, however, vertical or horizontal electrode oscillation or rotation of a circular electrode are other possible methods of agitation by electrode movement. Mechanical movement of the electrodes has obvious physical limitations. Since the electrode and bus-bar assembly are massive and cumbersome, it is not practical to accelerate them to high velocities and then decelerate to a stop in order to achieve a reciprocal motion. In practice, the maximum velocity that can be achieved during such reciprocation is about 15 ft/min, giving an average effective overall velocity of about 5 ft/min.

Electrolyte solution movement can be achieved by circulation of air through the electrolyte or by circulation of the solution through pumping. The latter is the most common method of moving the electrolyte past the electrodes. Its main drawback is that while at the pumping discharge the agitation can be very efficient, as the energy is being dispersed, the direction of the solution flow cannot be controlled over a larger surface, back pressure impediments to the flow occur, eddy currents are generated, and the desired uniformity of solution agitation cannot be maintained. In general, the solution movement that can be achieved through recirculation by pumping in commercial processes is quite low, typically in the order of less than 1 ft/min.

The current density that can be used in commercial electrolytic refining and recovery of metals has therefore been limited for practical reason to rather low values. For instance, when the metal is copper, the limiting current density is typically about 25 amps/sq.ft.

U.S. Pat. No. 4,053,377 discloses an electrolytic cell for electrodeposition of copper wherein some of these drawbacks of maintaining a high-velocity, uniform solution flow past the electrodes are overcome and wherein current densities in the range from 60 to 400 amps/sq.ft. are employed in the copper plating. Specifically, the electrolyte is introduced by means of an external centrifugal pump to the cell and passed through a series of baffles having increasing numbers of orifices into a venturi section, then through a narrow channel formed by a single cathode-anode pair. The electrolyte thereafter flows through an enlarged chamber and exits the cell via a conduit, which is connected to the suction inlet of the above-mentioned external pump. The dimensions of the cell are required to provide a uniform rate of movement of electrolyte past the electrode pair of at least 75 ft/min, and preferably of about 150 to 400 ft/min.

From an economical standpoint this cell design is impractical for use in commercial scale operations. One reason for this is that since a major portion of the cell tank is occupied by the baffle plates, the venturi section and the exit chamber, in which no plating takes place, and since the design only provides for one cathode plating surface per cell, the plating capacity per unit area of floor space occupied by the cell is extremely low.

Another reason is that the power requirements needed for recirculation of the electrolyte is excessive. Considering that in a commercial size cell the spacing between the anode and cathode surfaces should be sufficiently wide to permit build-up of a relatively thick deposit on the cathode surface before it is replaced, it follows that large volumes of the electrolyte must be pumped past the electrode surfaces at the required high lineal velocities. Since considerable energy losses are caused by the high velocity recirculation of the electrolyte by way of narrow pipes and with several rapid directional changes, and since additional considerable energy losses are encountered in passing the electrolyte through the series of apertured baffle plates, the use of external pipes and pumping means are highly inefficient in commercial applications of this cell.

It is, therefore, an object of the present invention to provide a novel electrolytic cell, wherein a moderate-velocity uniform, parallel movement of the electrolyte past all electrode surfaces is maintained while minimizing energy losses in moving said electrolyte. In addition to maximizing electrolyte velocity per unit of energy input, another object is to provide a practical, high-capacity cell design, which is economically feasible for commercial high-quality plating applications at high current densities. Other objects of the invention will become apparent from a reading of the specification, drawings and the appended claims.

BRIEF DESCRIPTION OF THE INVENTION

The above objects are achieved in a novel cell in which no abrupt directional changes in the flow of circulating electrolyte occur. The cell features a combination of a cell tank having arcuate or curved end walls, impellers disposed within the tank adjacent to the end walls, which impellers provide for internal recirculation of the electrolyte, and flow directional baffle arrangements extending from some of the electrodes for apportioning and guiding the electrolyte without undue impediments in the path of flow into the channels between the electrodes, which electrodes are positioned on each side of a central baffle parallelly therewith and with the tank side walls. Specifically, the electrolytic cell comprises a cell tank adapted to contain an electrolyte and having two side walls, two arcuate end walls and a bottom; adjacent to each arcuate end wall an impeller casing extending vertically to the bottom of the tank and having an arcuate inner surface, which faces the arcuate end wall; a centrally disposed baffle extending horizontally between the two impeller casings and vertically to the bottom of the tank; an impeller rotatably disposed within each of said impeller casings; means for rotating each of said impellers and imparting a recirculating flow to said electrolyte in the cell around the centrally disposed baffle; in each space between the centrally disposed baffle and an adjacent side wall at least one removable cathode disposed parallelly with the centrally disposed baffle and with said side wall, each cathode having two vertical surfaces and two vertical side edges; on each side of a cathode an anode parallelly and equidistantly spaced from said cathode, each anode having two vertical surfaces and two vertical side edges; vertical non-conductive vanes disposed unattachedly from those vertical side edges of said cathodes and of any anode interspaced between two cathodes, which side edges face the direction of flow of the recirculating electrolyte, said vanes extending partially towards the arcuate end walls of the tank; positioning adjustment means for said vanes to substantially equally proportion the flow of recirculating electrolyte through each of the channels formed by adjacent anodes and cathodes, and means for electrically energizing the cell.

DETAILED DESCRIPTION OF THE INVENTION

Figure 1:
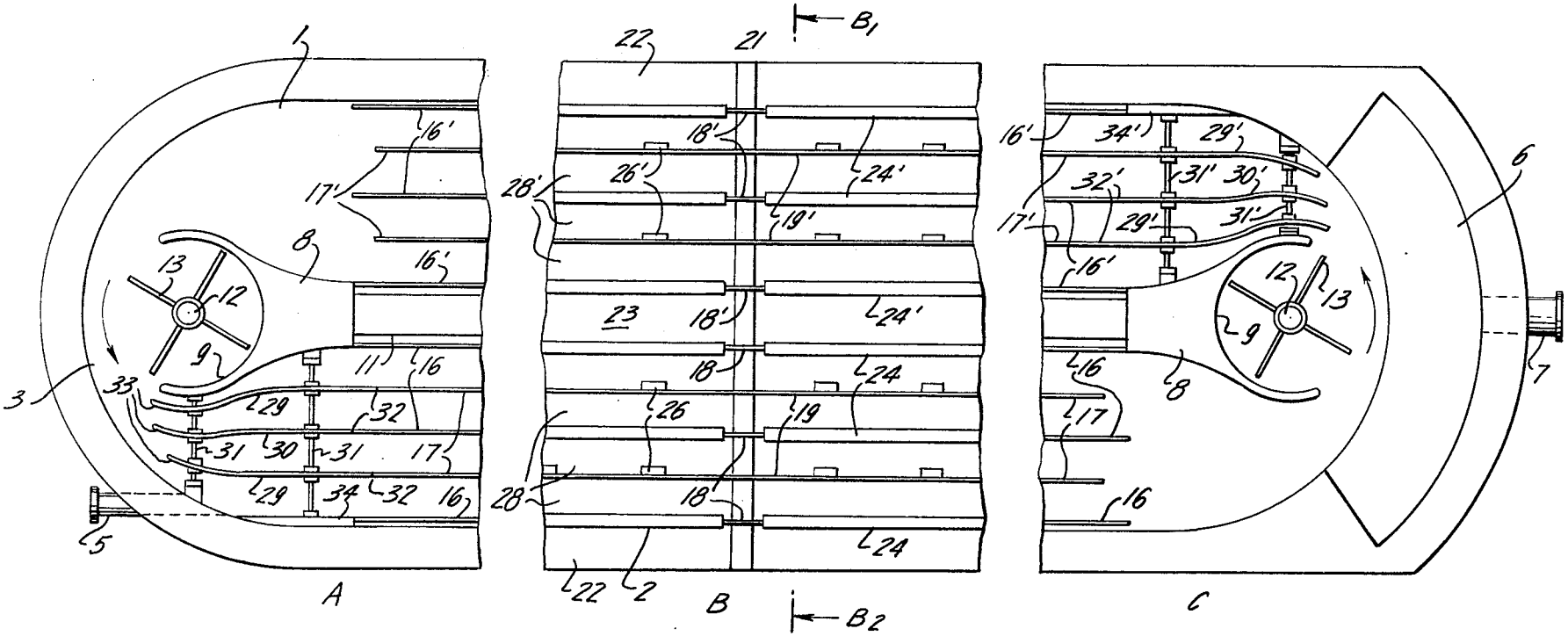
FIG. 1 is a fragmentary top view of the electrolytic cell of the invention. The end portions A and C of the cell are viewed from beneath the bus bar - insulator assembly.

For a better understanding the invention will be described with reference to the drawings, which show the essential features of the invention. However, various conventional auxiliary equipment such as support brackets, electrical connections, motors, valves, etc., have been omitted for the sake of simplicity. The cell comprises a relatively elongated flanged tank 1 having straight side walls 2, arcuate end walls 3 and a bottom 4. Only the inside of the end walls need to have the arcuate shape and the tank could, if desired, be constructed with straight end walls and provided with internal curved baffle sections in the corners, which would give the required curved shape of the tank at its ends. For the purpose of this application, the definition of the terms "arcuate end wall" or "curved end wall" also covers such an internal baffle arrangement.

The cell tank is provided with an inlet 5, which preferably is located near the bottom of one end of the tank for introduction of fresh electrolyte tangentially with one of the side walls. On the opposite side of the tank, there is located a conventional overflow 6 having outlet 7, which is sufficiently elevated to maintain a desired level of electrolyte within the tank. Near the end walls there are two impeller casings 8, which extend upwardly from the bottom of the tank to above the normal level of the electrolyte. Each casing has an inner arcuate surface 9, which faces the respective end wall. Center baffle 11 extends upwardly from the bottom of the tank to above the electrolyte level and connects in a horizontal direction with the two impeller casings. Within each of the casings, there is an impeller 12 having vertically extending vanes 13 mounted on its shaft. The motors (not shown on the drawings) drive the impellers in the directions indicated by the arrows, thereby imparting a circulating flow of the electrolyte within the cell. Suspended vertically into the tank in the spaces between and parallelly with the center baffle and the side walls there are sets of anodes 16 and 16' and interspaced cathodes 17 and 17'. The electrodes which are spaced substantially equidistantly from each other are suspended from the respective bus bars 18, 18', 19 and 19'. In the cell depicted in the drawings the bus bars are supported in the grooves of insulated rods 21 (one of five shown) which rods are spaced across the open top of the tank and mounted on tank wall flanges 22 and on flange 23, which is attached to the center baffle. When insoluble anodes are used, the tops of the anodes are preferably bent around the bus bars 18 and 18' as shown, and the bent sections 24 and 24' are bolted to the bus bars to provide for intimate electrical contact. The cathodes (and optionally the anodes) are removably attached to their respective bus bars 19 and 19' e.g. by means of bolted hangers 26. In order to facilitate the removal of the electrodes, especially the cathodes, without dismantling the aforementioned overhead bus bar - insulator support assembly, the electrodes are advantageously divided into several plate sections, which can be removed individually, e.g. by pulley drawn hooks, which are inserted in the holes 27 and 27' of the hangers 26 and 26'. However, other bus bar assemblies are obviously possible, which would not necessitate sectioning of the electrodes. Similarly, other means than those described above for achieving electrical contact between an electrode and its corresponding bus bar are also possible. To minimize undesired excessive plating at the edges of the cathodes, the cathodes surfaces are preferably larger than those of the anodes such that the side and bottom edges of the cathodes are offset from the respective edges of the adjacent anodes.

In each of the two electrode assemblies shown in the figures there are two cathodes and three anodes, however, the invention is intended to cover cells containing one or more e.g. 1 to 6 cathode rows with an appropriate number of anodes in each of these assemblies.

In order to direct and apportion the flow of electrolyte through the channels 28 and 28' formed by neighboring electrodes, there are provided vertical, non-conductive vanes 29 and 29', which form unattached extensions of the cathodes 17 and 17'. Similarly, vanes 30 and 30' extend from those anodes, which are positioned between the cathodes. In a horizontal direction, the vanes, which are adjustably supported by spacer rods 31 and 31' extend partially to the side walls from those electrode side edges 32 and 32', which face the direction of flow of the recirculating electrolyte. Vertically, the vanes extend at least along the full submerged depths of their respective electrodes, in some cases to the bottom of the tank. The vanes, which provide electrolyte inlets to the channels 28 and 28' are adjustably positioned by the aforementioned spacer rods to distribute the flow of electrolyte uniformly among each of the channels between the electrodes. Preferably at least the outermost portions 33 and 33' of the vanes i.e. those portions which are nearest to an end wall, have arcuate shapes, which conform to the arcuate shape of the adjacent end wall. Vanes 34 and 34' extend to the end walls from those anodes, which are immediately adjacent to the side walls. Their function is merely to aid in the smooth flow of the electrolyte around the walls of the cell.

Turbulence and frictional losses are minimized in the cell of the present invention because of the combined action of the impellers, the curved end walls and the vanes. The electrolyte, which can be visualized as a tall wall or curtain of liquid, is moved by the push-pull action of the impellers and around the curved end walls with no abrupt directional changes. The vanes, which act as knives slicing off portions of this moving wall to give equal flow in the channels, offer a minimum of resistance due to the small frontal area of the knife-like edges contacting the oncoming liquid.

Figure 3:
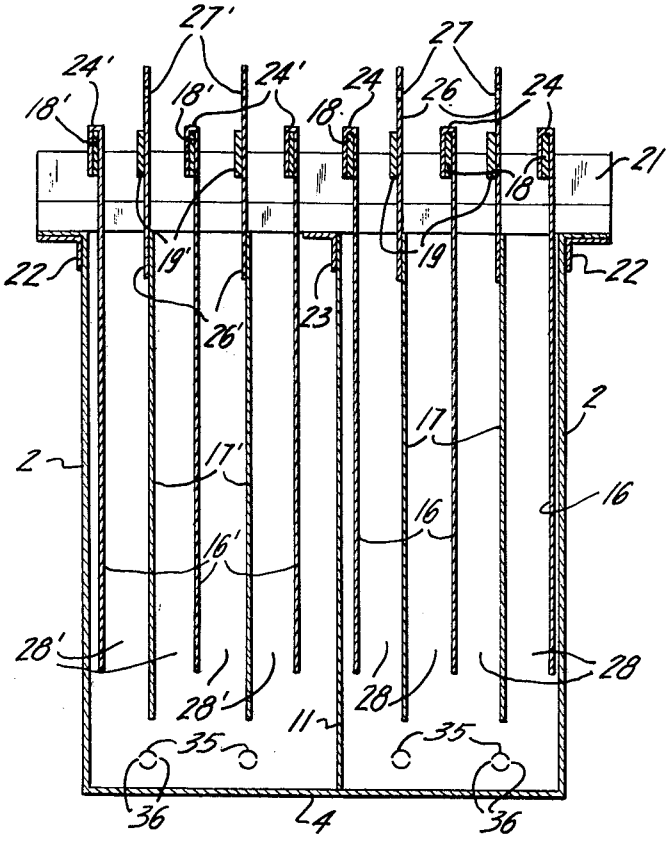
FIG. 3 is a horizontal cross-sectional view taken on line $B_1$–$B_2$ of FIG. 1 showing the electrodes and, in addition, a modification of the cell suitable for use in slurry plating operations.
Figure 2:
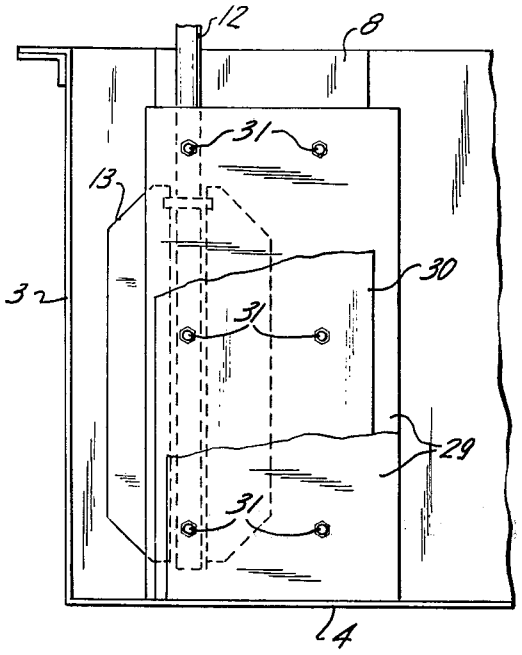
FIG. 2 is a fragmentary side view of end portion A of the cell showing the flow directional vanes.

When the cell is to be used in an electrolytic process using a slurry electrolyte it is usually desirable to include some modifications to prevent the solids in the slurry from settling out and being deposited on the bottom of the cell tank. FIG. 3 shows one such possible modification. Thus a series of parallel sparger pipes 35 having a multitude of spaced apertures 36 are located in the bottom portion of the tank. Either a gas, such as air, is supplied (not shown) to the pipes to provide the lift required to suspend the solids of the slurry substantially uniformly within the liquid phase, or the slurry elecrolyte itself is recirculated (not shown) through the sparger. In either case, the upward velocity required to maintain the desired non-settled condition of the slurry solids is relatively low as compared to the velocity of the electrolyte passing through the channels. Usually an upward velocity in the range of from about 3 ft/min to about 15 ft/min is adequate to prevent settling of the solids, however, the actual velocities to be used in any specific situation depend, as is well known in the art, on the extent of solids loading, particle size distribution of the solids and density differences between the solids and the liquid phase.

In a commercial size unit, the spacing between the electrodes should be at least about 2 inches preferably between about 3 to about 6 inches to allow for a rather thick deposit to build up on the cathode surfaces before the cathodes need to be replaced, and also to provide sufficient room for electrode support configuration and for the rather rough handling of the electrodes during replacement. The impellers and their motors should be sized to result in a linear velocity of the electrolyte through each of the channels of from about 30 ft/min to about 300 ft/min, preferably between about 60 to about 180 ft/min.

The cell of this invention is used with advantage in a variety of electrolytic metal refining processes as well as in metal recovery processes, e.g. electrowinning, regeneration of metal treatment solutions and recovery of metal values from metal salts. The electrolyte can be a solution containing the metal values as ions, or a slurry, wherein metal bearing solids provide the source of metal ions to be plated out on the cathodes. Metal values such as copper, nickel, iron, cobalt, zinc, cadmium, etc., can be recovered as high quality cathode deposits from appropriate solutions or slurries providing the source of metal ions. The metal electrodeposition processes can be carried out successfully and economically on a commercial scale as relatively high current densities, typically above 40 amps/sq.ft.

To further illustrate the invention, a copper pickling solution was treated in a semi-commercial size cell substantially as shown in the drawings, except that the two electrode assemblies each consisted of two anodes and one interspaced cathode, and no spargers were present in the bottom of the tank. The cell was 5 feet long, 2.5 feet wide and 4 feet deep. The anodes were made of 3/16 inch lead alloy, and the cathodes of ⅛ inch stainless steel. The spacing between a cathode and an adjacent anode was 3 inches and the total area of all cathode surfaces submerged in the electrolyte was 24 square feet. The electrolyte i.e. the copper pickling solution which had a free sulfuric acid concentration of 10 weight percent and a copper ion concentration of about 35–40 g/l, was recirculated through the channels formed by the electrodes at a measured flow rate of about 60 ft/min. The electrodeposition, which was conducted at about 120° F., and at about 80 amp/sq.ft. current density, was allowed to continue until the copper had built up to about ⅛ inch on each cathode surface and the cathodes were then replaced. In each of four separate experiments, there resulted a fine grained, dense, malleable copper deposit of substantially the same quality as that obtained in prior art commercial operations at 25 amp/sq.ft. current density.

Thus having described the invention in detail it will be understood by those skilled in the art that certain variations and modifications may be made without departing from the spirit and scope of the invention as described herein or in the appended claims.

What is claimed is:

1. An electrolytic cell which comprises:

a cell tank adapted to contain an electrolyte and having two side walls, two arcuate end walls and a bottom;

adjacent to each arcuate end wall an impeller casing extending vertically to the bottom of the tank and having an arcuate inner surface, which faces the arcuate end wall;

a substantially centrally disposed baffle extending horizontally between the two impeller casings and vertically to the bottom of the tank;

an impeller rotatably disposed within each of said impeller casings;

means for rotating each of said impellers and imparting a recirculating flow to said electrolyte in the cell around the centrally disposed baffle;

in each space between the centrally disposed baffle and an adjacent side wall at least one removable cathode disposed parallelly with the centrally disposed baffle and with said side wall, each cathode having two vertical surfaces and two vertical side edges;

on each side of a cathode an anode parallelly and equidistantly spaced from said cathode, each anode having two vertical surfaces and two vertical side edges;

vertical non-conductive vanes disposed unattachedly from those vertical side edges of said cathode and of any anode interspaced between two cathodes, which side edges face the direction of flow of the recirculating electrolyte, said vanes extending partially towards the arcuate end walls of the tank;

positioning adjustment means for said vanes to substantially proportion the flow of recirculating electrolyte through each of the channels formed by adjacent anodes and cathodes, and means for electrically energizing the cell.

2. The electrolytic cell of claim 1 in which the vanes have arcuate shapes at least at the portions which are closest to the end walls, the arcuate shapes of the vanes conforming to the shape of the arcuate end walls.

3. The electrolytic cell of claim 1 wherein sparger means are disposed in the bottom portion of the tank.

4. The electrolytic cell of claim 1, wherein the space between the surfaces of adjacent anodes and cathodes is at least about 2 inches.

5. The electrolytic cell of claim 1 wherein the space between the surfaces of adjacent anodes and cathodes is between about 3 to about 6 inches.

6. A process employing the cell of claim 1, for electrodepositing metal values on the cathodes thereof while recirculating electrolyte therethrough.

7. The process of claim 6, wherein current densitites of about at least 40 amps/sq.ft. are employed.

* * * * *